US011414799B2

(12) United States Patent
Tseng

(10) Patent No.: US 11,414,799 B2
(45) Date of Patent: Aug. 16, 2022

(54) FEED-DOG STABILIZING MECHANISM FOR A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 947 days.

(21) Appl. No.: 16/152,020

(22) Filed: Oct. 4, 2018

(65) Prior Publication Data

US 2020/0109500 A1 Apr. 9, 2020

(51) Int. Cl.
*D05B 27/00* (2006.01)

(52) U.S. Cl.
CPC ..... *D05B 27/00* (2013.01)

(58) Field of Classification Search
CPC ..... D05B 27/24; D05B 27/00; D05B 27/02; D05B 27/04; D05B 27/06; D05B 27/08
USPC ..... 112/324
See application file for complete search history.

(56) References Cited

U.S. PATENT DOCUMENTS

2018/0080156 A1* 3/2018 Nakajima ..... D05B 69/24

* cited by examiner

*Primary Examiner* — Nathan E Durham
(74) *Attorney, Agent, or Firm* — Wang Law Firm, Inc.

(57) ABSTRACT

A feed-dog stabilizing mechanism for a sewing machine essentially includes a support member and a drive source. The support member is disposed below a feed dog and driven to move by the drive source, so that the support member can push against the feed dog, and as a result, the height at which the fabric is bitten by the feed dog can be maintained during the course of fabric feeding to maintain the optimum feeding efficiency.

9 Claims, 12 Drawing Sheets

FEED-DOG STABILIZING MECHANISM FOR A SEWING MACHINE

BACKGROUND

Field of the Invention

The present invention relates to a feed-dog stabilizing mechanism for a sewing machine, which is related to the structure for supporting the feed dog of the fabric feeding mechanism.

Related Prior Art

A conventional sewing machine with feed dogs, comprises: a single-feed-dog or double-feed-dog sewing machine which is provided with a presser foot located above the feed dogs, the presser foot presses downward to cooperate with the feed dogs which bite the fabric from under and moves back and forth to feed the fabric. However, the feed dogs have to be capable of moving back and forth, and left and right. Therefore, the set of feed dogs is disposed in a suspended form below the presser foot. The only support force comes from a drive mechanism located at the end of the set of the feed dogs to push the feed dogs to move. The drive mechanism is located a distance from the end portion of the set of feed dogs pressed by the presser foot, therefore, the force for supporting the feed dog is limited, so that when the presser foot presses down, the feed dogs are forced downward and cannot surely cooperate with the presser foot to bite the bottom surface of the fabric, as a result, the fabric cannot be surely bitten and moved by the feed dogs, which reduces the feeding efficiency and is necessary for improvement.

Further, as shown in FIGS. 1-3, a conventional double-feed-dog sewing machine essentially comprises a body 10, and a spindle 11 disposed in the body 10 and driven to rotate by a power source. The spindle 11 passes through an eccentric hole 121 of a bearing seat 12, a feed table 13 leans against the bearing seat 12, a feed dog 14 is disposed on the feed table 13, a differential adjustment device 16 is disposed at one end of the feed table 13 opposite to the end where the feed dog 14 is located, and an inserting rod 15 is inserted through the feed table 13 and driven by the differential adjustment device 16, so that the inserting rod 15 is caused to move synchronously or differentially with the feed table 13. Another feed table 17 is fixed to one end of the inserting rod 15 to extend relative structures and connected to another feed dog 18, so that the feed table 17 and the feed dog 14 feed fabric in a synchronous or differential manner.

However, the feed table 17 essentially comprises a fixing member 171, an L-shaped support member 172 and an extension member 173 which form a suspended bow-shaped frame.

Since the feed table 17 is fixed to the end of the inserting rod 15 only by the fixing member 171, in a normal use position, when the presser foot under the feed dog 18 presses against the fabric, it will push the feed dog 18, and the supporting force of the feed dog 18 is obviously insufficient, that is, the L-shaped support member 172 of the feed table 17 and the extension member 173 are likely to be deformed when the feed dog 18 is pressed, as a result, the feed dog 18 can not be surely moved up to cooperate with the presser foot to bite the fabric, so that the fabric is easy to slip off and can not be reliably fed by the feed dog 18, and in view of this, it is necessary to solve the problem that the feed table 17 is easily deformed.

The present invention has arisen to mitigate and/or obviate the afore-described disadvantages.

SUMMARY

One objective of the present invention is to solve the problem that the feeding dog and the presser foot are incapable of reliably biting the fabric, thereby improving the feeding efficiency.

To solve the above problem, a feed-dog stabilizing mechanism for a sewing machine in accordance with the present invention, comprises:

the sewing machine including a feed dog and a body;

a support member pivotally mounted on the body, and including: a first abutting surface facing the feed dog and a second abutting surface opposite to the first abutting surface, by pivoting the support member, the first abutting surface of the support member is able to abut against or move away from the feed dog; and a drive source having a driving arm, wherein the driving arm pushes the second abutting surface to move the support member.

Preferably, the drive source includes a first linkage rod, a second linkage rod and the driving arm, one end of the first linkage rod is pivotally connected to the second linkage rod, the second linkage rod has a middle section of pivotally connected to the body of the sewing machine and has one end connected to the driving arm, so that, when the first linkage rod is driven by the sewing machine, the second linkage rod drives the driving arm to move.

Preferably, the one end of the first linkage rod is provided with a first pivot hole, another end of the first linkage rod is provided with a linkage-rod hole, the second linkage rod has another end pivotally coupled to the first pivot hole by a first pivot rod, and has the one end provided with a second pivot hole, a second linkage-rod hole is formed between the two ends of the second linkage rod, the second linkage rod is pivotally coupled to the body by a pivot shaft inserted through the second pivot hole, the driving arm has one end pivotally connected to the second pivot hole by a second pivot rod, a limiting member is fixed to the body and includes a limiting hole, and the driving arm is slidably disposed in the limiting hole.

Preferably, the drive source includes a motor which drives the driving arm to move.

Preferably, the drive source has a sleeve, the driving arm is disposed in the sleeve, and the sleeve is provided with a coil to drive the driving arm.

Preferably, the second abutting surface has an abutting portion to abut against the driving arm, through displacement of the driving arm, the first abutting surface supports the feed dog during displacement of the feed dog.

Preferably, a spindle capable of transmitting power is disposed in the body, a bearing seat is mounted on the spindle, a sub-feed table is disposed in the body and rests against the bearing seat in a slidable manner, the sub-feed table is provided with a sub-feed dog, one end of the sub-feed table is provided with a clamping slot, an inserting rod is slidably inserted in the sub-feed table, a feed table is capable of sliding in the clamping slot, the feed table is fixed to the inserting rod, and the feed dog is provided on the feed table.

Thereby, when the feed-dog stabilizing mechanism of the sewing machine of the present invention is in use, the feed table is supported by the support member, thereby solving the disadvantage that the feed table is easily deformed during use. In addition, the height at which the fabric is bitten by the feed dog can be maintained during the course of fabric feeding to maintain the optimum feeding efficiency.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
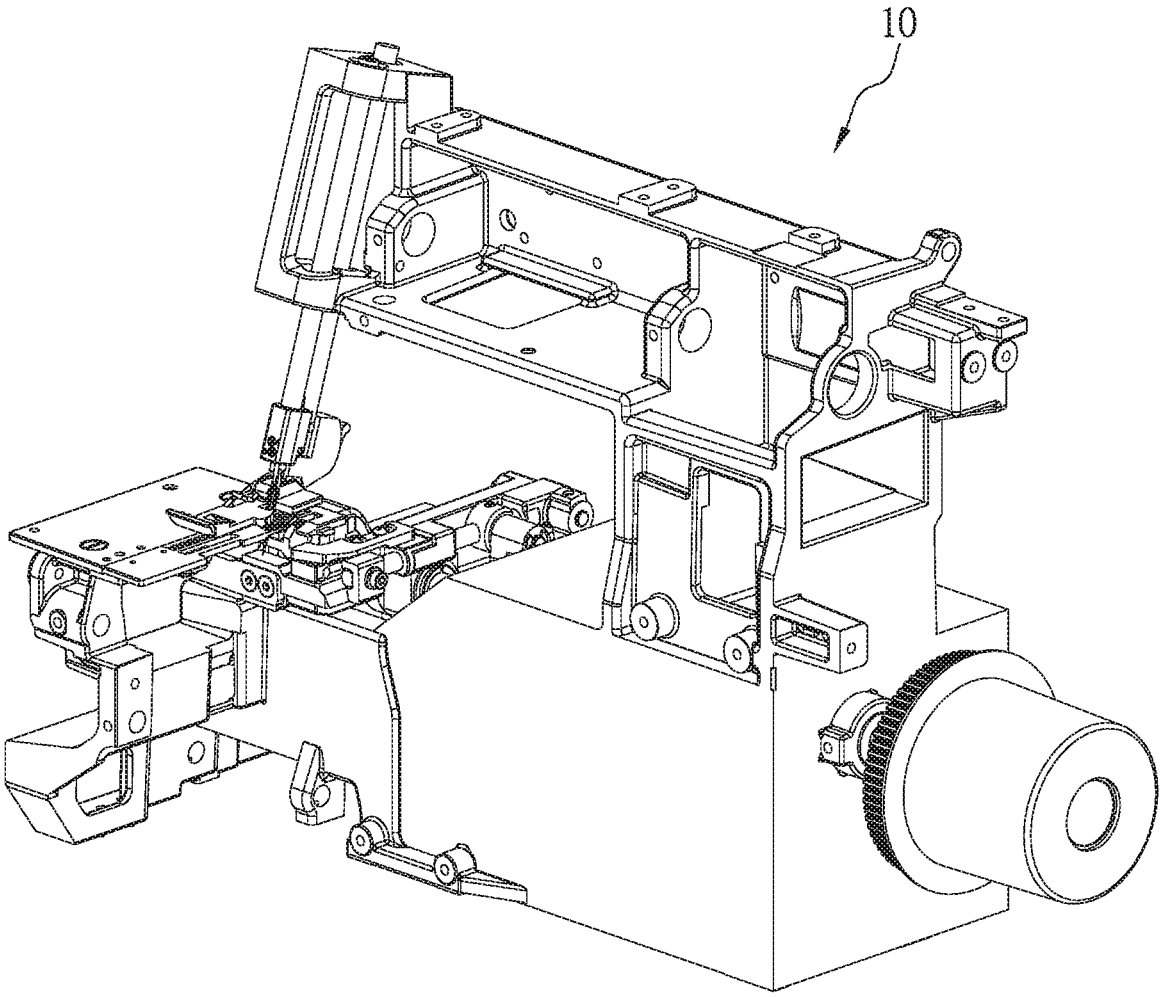
PRIOR ART FIG.1
FIG. 1 is a perspective view of a conventional double-feed-dog sewing machine.
Figure 2:
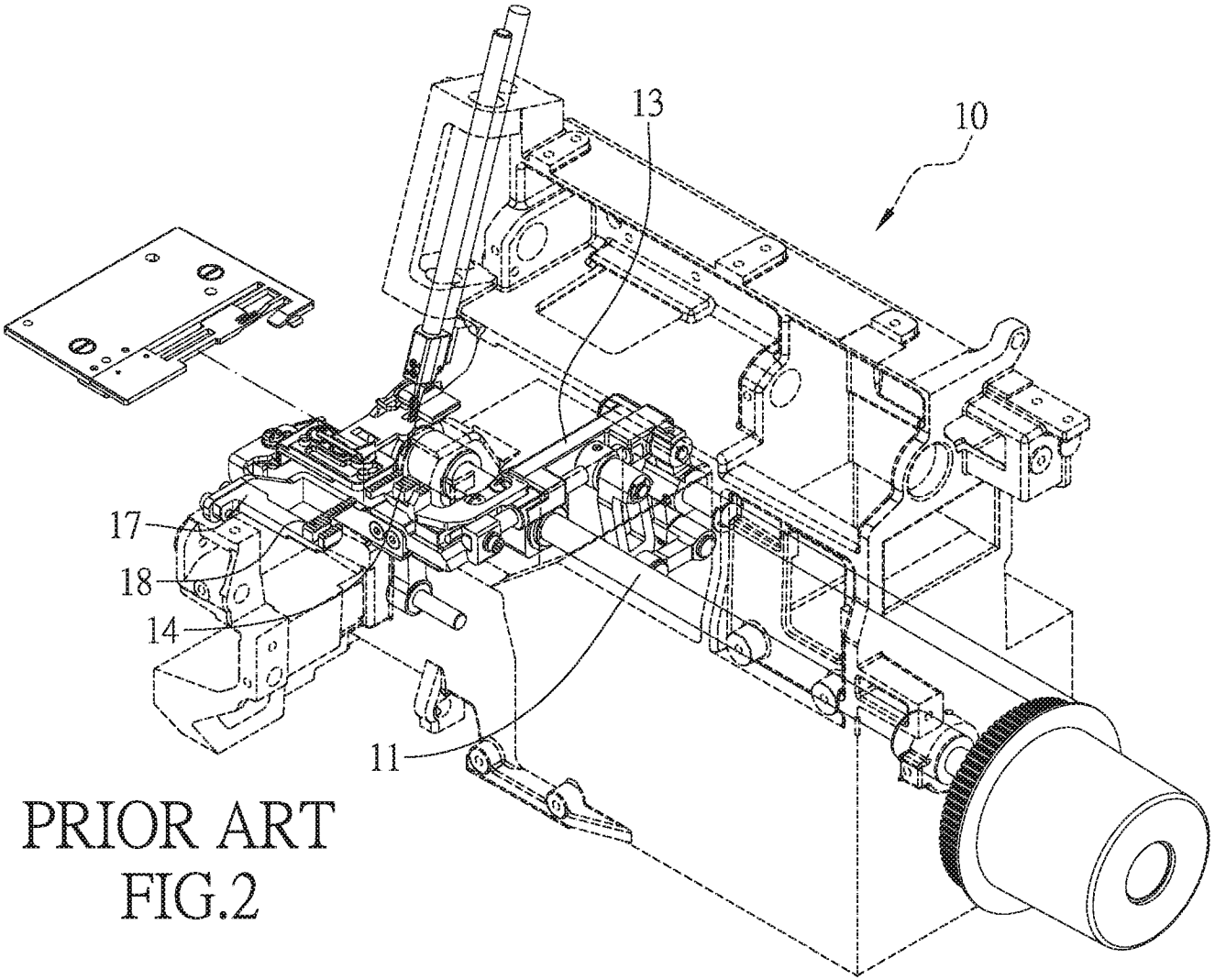
PRIOR ART FIG.2
FIG. 2 is a perspective view of a conventional double-feed-dog sewing machine.
Figure 3:
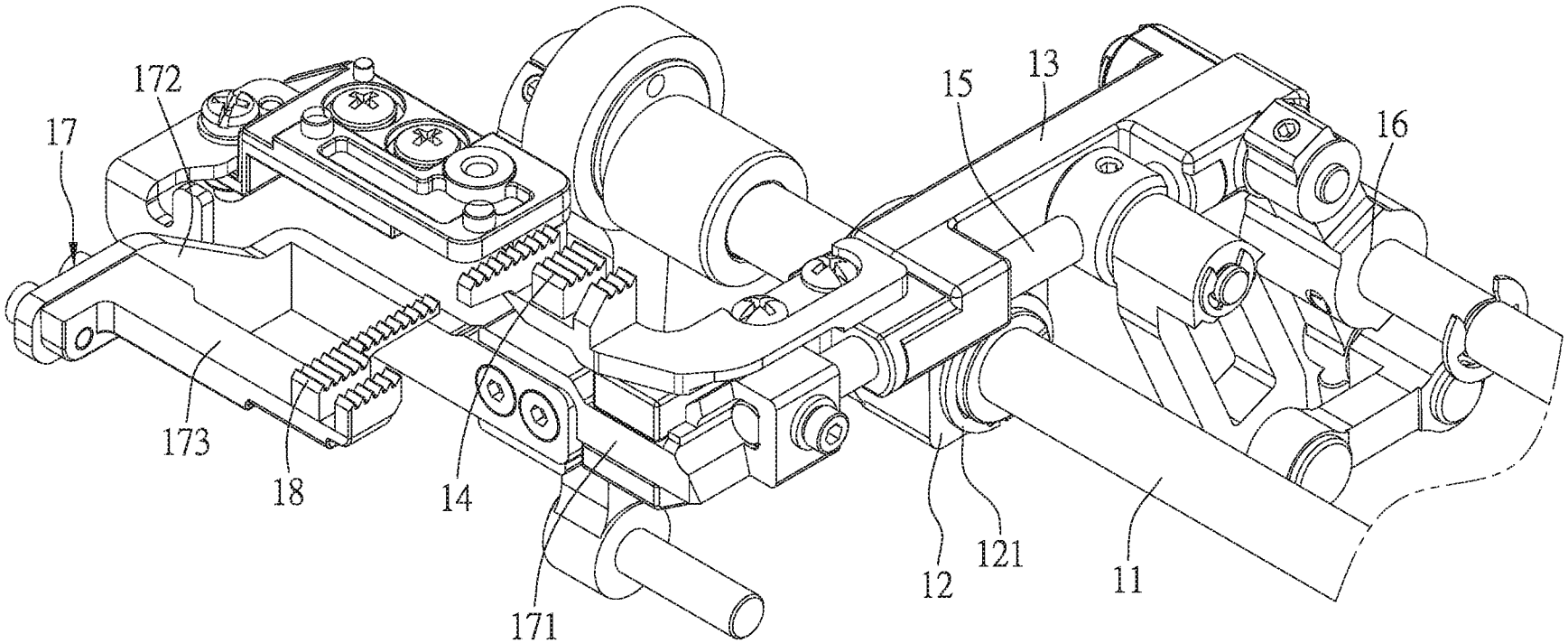
PRIOR ART FIG.3
FIG. 3 is a magnified view of a part of the conventional double-feed-dog sewing machine.
Figure 4:
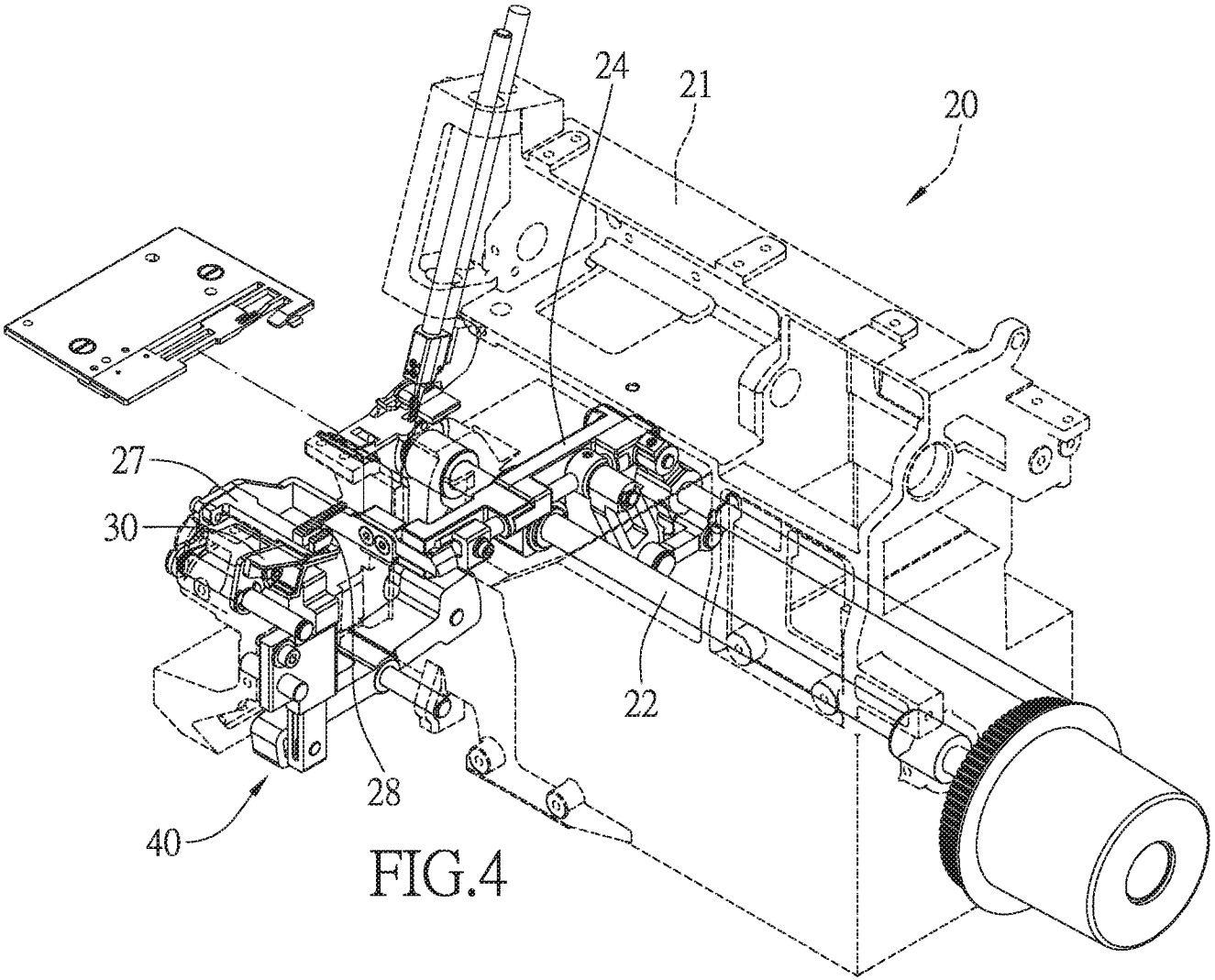
FIG. 4 is a perspective view of a feed-dog stabilizing mechanism for a sewing machine in accordance with a preferred embodiment of the present invention.
Figure 5:
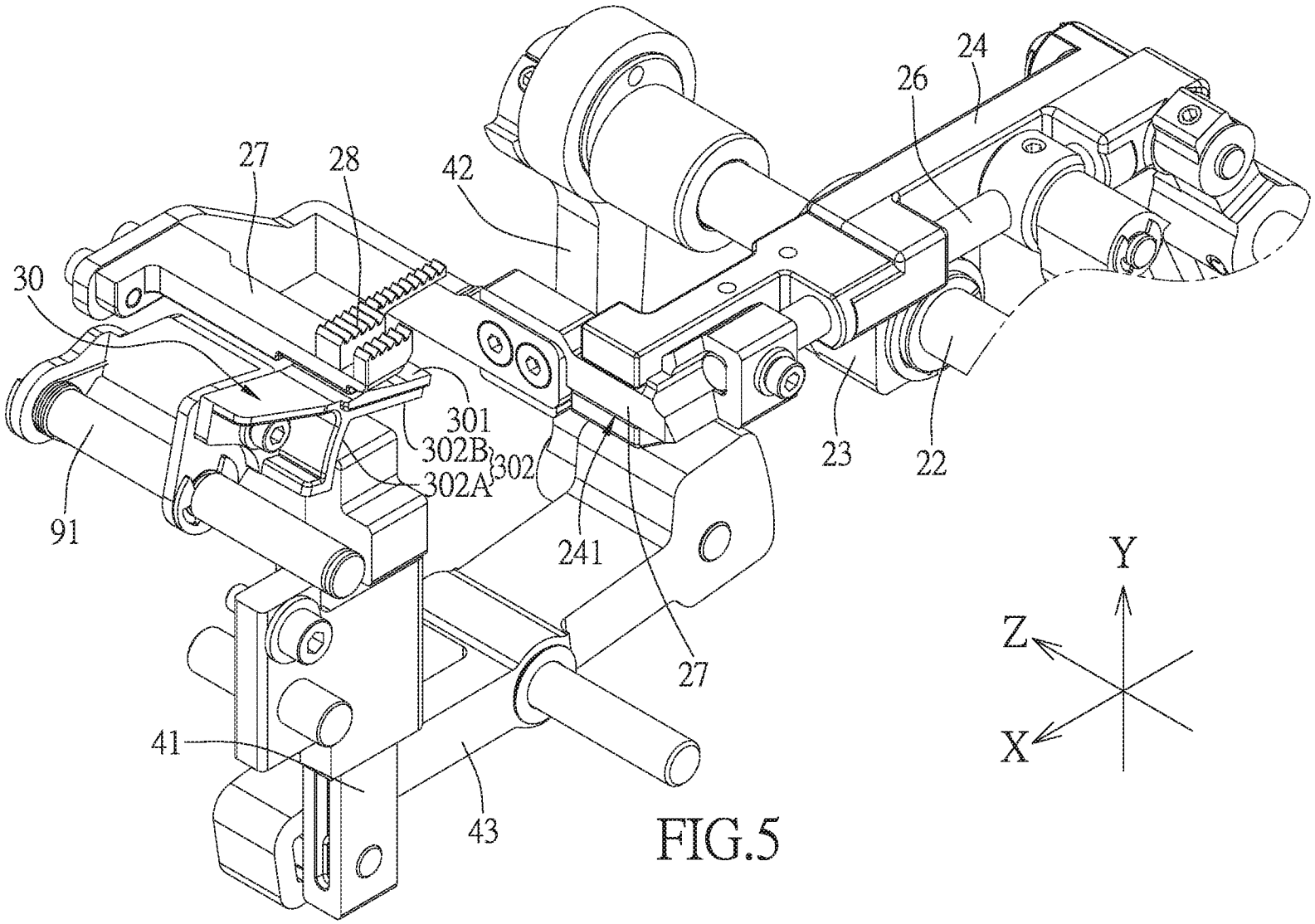
FIG. 5 is a perspective view of a feed-dog stabilizing mechanism for a sewing machine in accordance with a preferred embodiment of the present invention.
Figure 6:
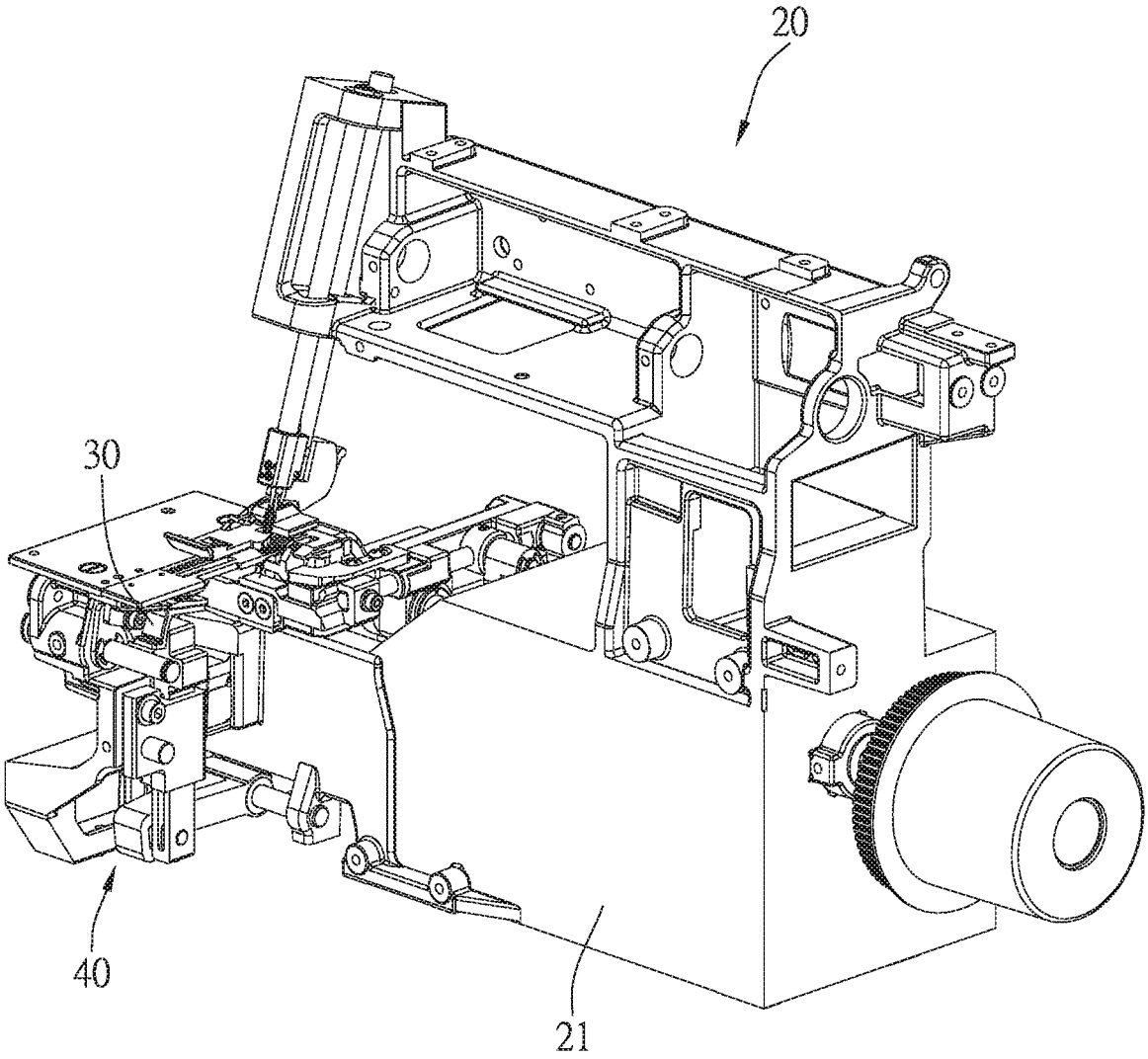
FIG. 6 is a perspective view of a feed-dog stabilizing mechanism for a sewing machine in accordance with another preferred embodiment of the present invention.
Figure 7:
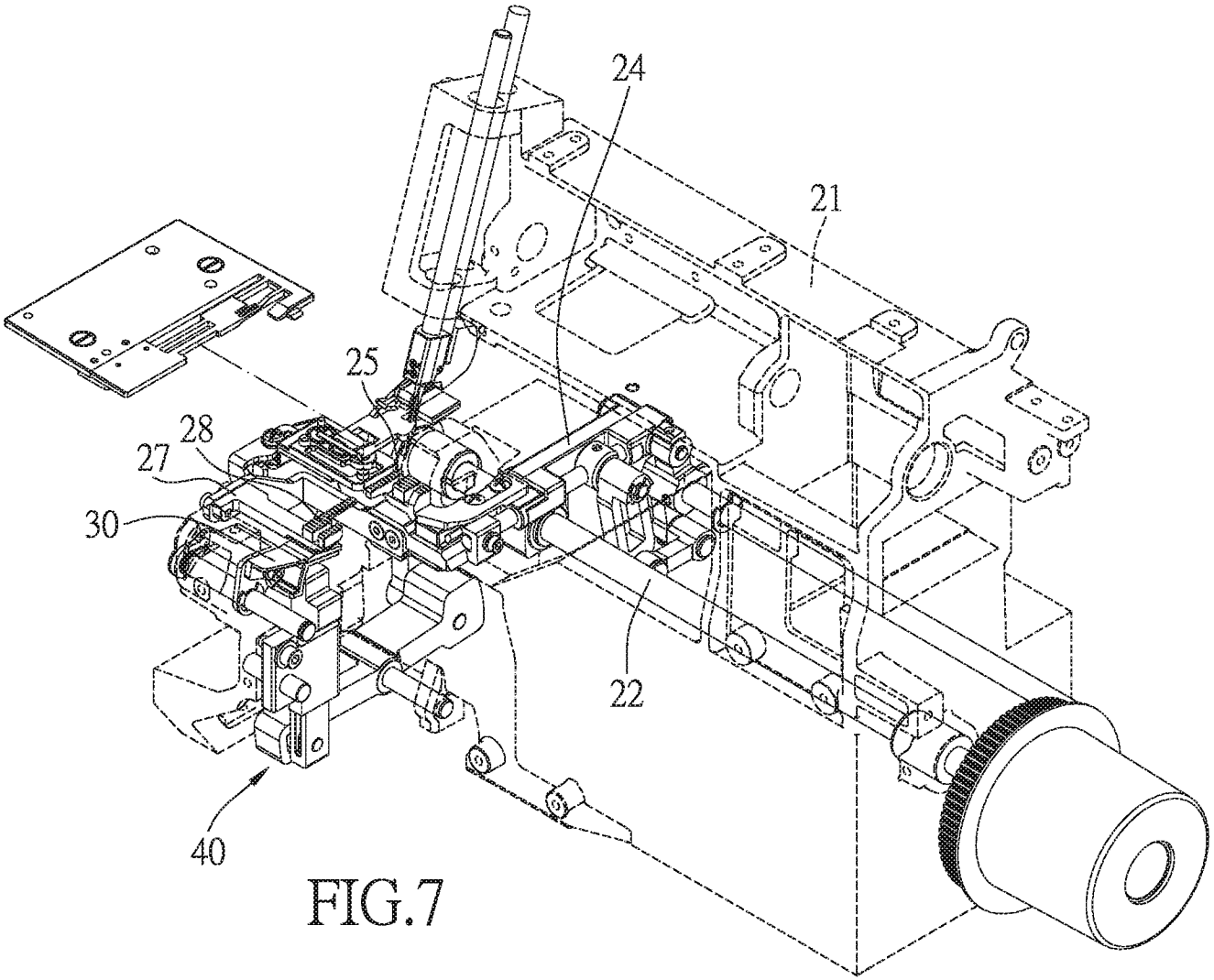
FIG. 7 is a partial exploded view of the feed-dog stabilizing mechanism for a sewing machine in accordance with another preferred embodiment of the present invention.

Referring to FIGS. 4 and 5, a feed-dog stabilizing mechanism for a sewing machine in accordance with the present invention, comprises: the sewing machine 20, a support member 30, and a drive source 40.

The sewing machine 20 includes a body 21 and a spindle 22 pivotally disposed in the body 21. One end of the spindle 22 extends out of the body 21 for mounting of a drive force. A bearing seat 23 is provided on the spindle 22. An extending direction of the spindle 22 is defined as a first direction Z, and the first direction Z is perpendicular to a second direction X and a vertical direction Y which are perpendicular to each other. A sub-feed table 24 is disposed in the body 21 and slidable along the second direction X to rest against the bearing seat 23. One end of the sub-feed table 24 has a clamping slot 241, and an inserting rod 26 is inserted in the sub-feed table 24. The inserting rod 26 is slidable along the second direction X with respect to the sub-feed table 24. A feed table 27 is clamped in the clamping slot 241 and fixed to the inserting rod 26, so that the feed table 27 can be driven by the inserting rod 26 to slide with respect to the sub-feed table 24 along the second direction X, and a feed dog 28 is fixed on the feed table 27.

The support member 30 is pivotally mounted on the body 21 by a pivot 91, and includes: a first abutting surface 301 facing the feed dog 28 and a second abutting surface 302 opposite to the first abutting surface 301. The first abutting surface 301 is provided to abut against the feed dog 28. By pivoting the support member 30, the first abutting surface 301 of the support member 30 can be abutted against or away from the feed dog 28. A direction extending between the first abutting surface 301 and the second abutting surface 302 is the vertical direction Y.

The drive source 40 has a driving arm 41 movable in the vertical direction Y, such that one end of the driving arm 41 facing the second abutting surface 302 pushes the support member 30 to move.

Referring to FIGS. 5-9, in a preferred embodiment, the drive source 40 further includes a first linkage rod 42, a second linkage rod 43 and a limiting member 44. One end of the first linkage rod 42 is provided with an eccentric linkage-rod hole 421, and another end of the first linkage rod 42 is provided with a first pivot hole 422. The eccentric linkage-rod hole 421 is provided for insertion of the spindle 22, and the first linkage rod 42 is moved in an arc manner along a plane defined by the second direction X and the vertical direction Y by the rotation of the spindle 22.

The second linkage rod 43 has one end pivotally coupled to the first pivot hole 422 by a first pivot rod 92, and has another end provided with a second pivot hole 431. A second linkage-rod hole 432 is formed between the two ends of the second linkage rod 43. The second linkage rod 43 is pivotally coupled to the body 21 by a pivot shaft 93 inserted through the second linkage-rod hole 432. Another end of the driving arm 41 is pivotally connected to the second pivot hole 431 by a second pivot rod 94.

The limiting member 44 is fixed to the body 21, and includes a limiting hole 441 running through the limiting member 44 along the vertical direction Y The driving arm 41 is slidably disposed in the limiting hole 441 along the vertical direction Y, thereby restricting the sliding direction of the driving arm 41, so that the driving arm 41 can only slide along the vertical direction Y.

In another preferred embodiment, the drive source 40 is an electromagnet, and the electromagnet has a sleeve in addition to the driving arm 41. The driving arm 41 is disposed in the sleeve. The sleeve is provided with a coil and a core, and the driving arm 41 is an armature. The core and the driving arm 41 are magnetized by energizing the coil, thereby moving the driving arm 41 toward the core, and when the coil is powered, the driving arm 41 returns to the original position by the reaction force, thereby enabling the driving arm 41 to move back and forth in the sleeve along the vertical direction Y.

Preferably, the drive source 40 further includes a motor which drives the driving arm 41 to move.

The second abutting surface 302 has a first abutting portion 302A and a second abutting portion 302B connected to the first abutting portion 302A. There is an angle between the first abutting portion 302A and the second abutting surface 302B. The first abutting portion 320A extends along the second direction X and is located toward the driving arm 41, and the second abutting portion 302B extends along the vertical direction Y and is located toward the driving arm 41. The driving arm 41 has a first pushing surface 411 facing the first abutting portion 302A and a second pushing surface 412 facing the second abutting portion 302B. There is an abutting angle 413 between the first pushing surface 411 and the second pushing surface 412 for abutting against the first abutting portion 302A, and the second pushing surface 412 is provided for abutting against the second abutting portion 302B.

Preferably, the driving arm 41 moves back and forth along the vertical direction Y to switch the driving arm 41 between a release position Q1 and a prop-up position Q2. When the driving arm 41 is in the release position Q1, the second pushing surface 412 does not abut against the support member 30, so that the support member 30 is away from the feed dog 28. When the driving arm 41 is in the prop-up position Q2, the second pushing surface 412 abuts against the second abutting portion 302B of the support member 30, so that the support member 30 pivots to abut against and support the feed table 27.

Referring to FIGS. 6-12, in another preferred embodiment of the invention, the sub-feed table 24 is provided with a sub-feed dog 25 to make the invention a double-feed-dog sewing machine.

Figure 8:
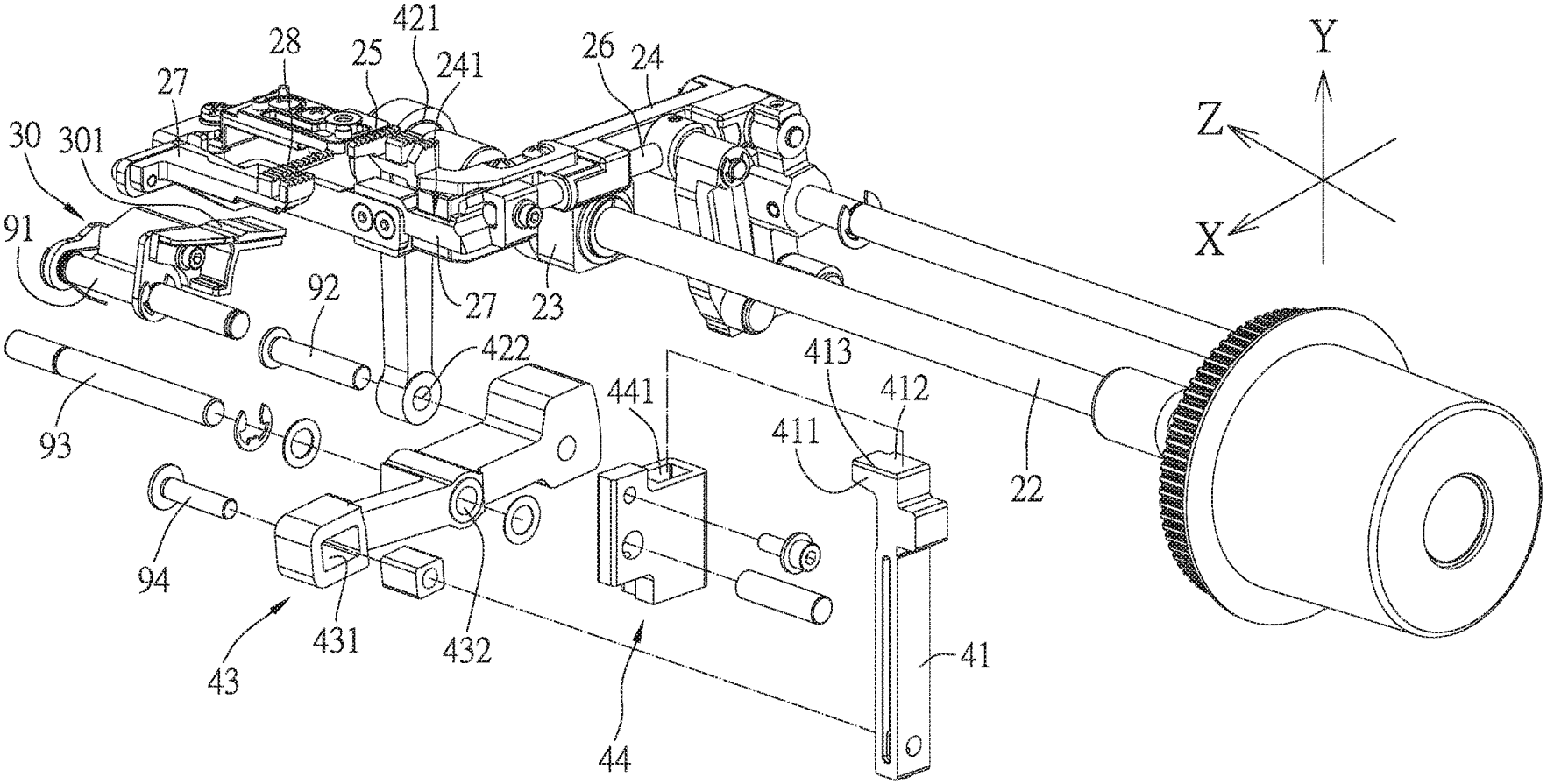
FIG. 8 is an exploded view of a part of the feed-dog stabilizing mechanism for a sewing machine in accordance with another preferred embodiment of the present invention.
Figure 9:
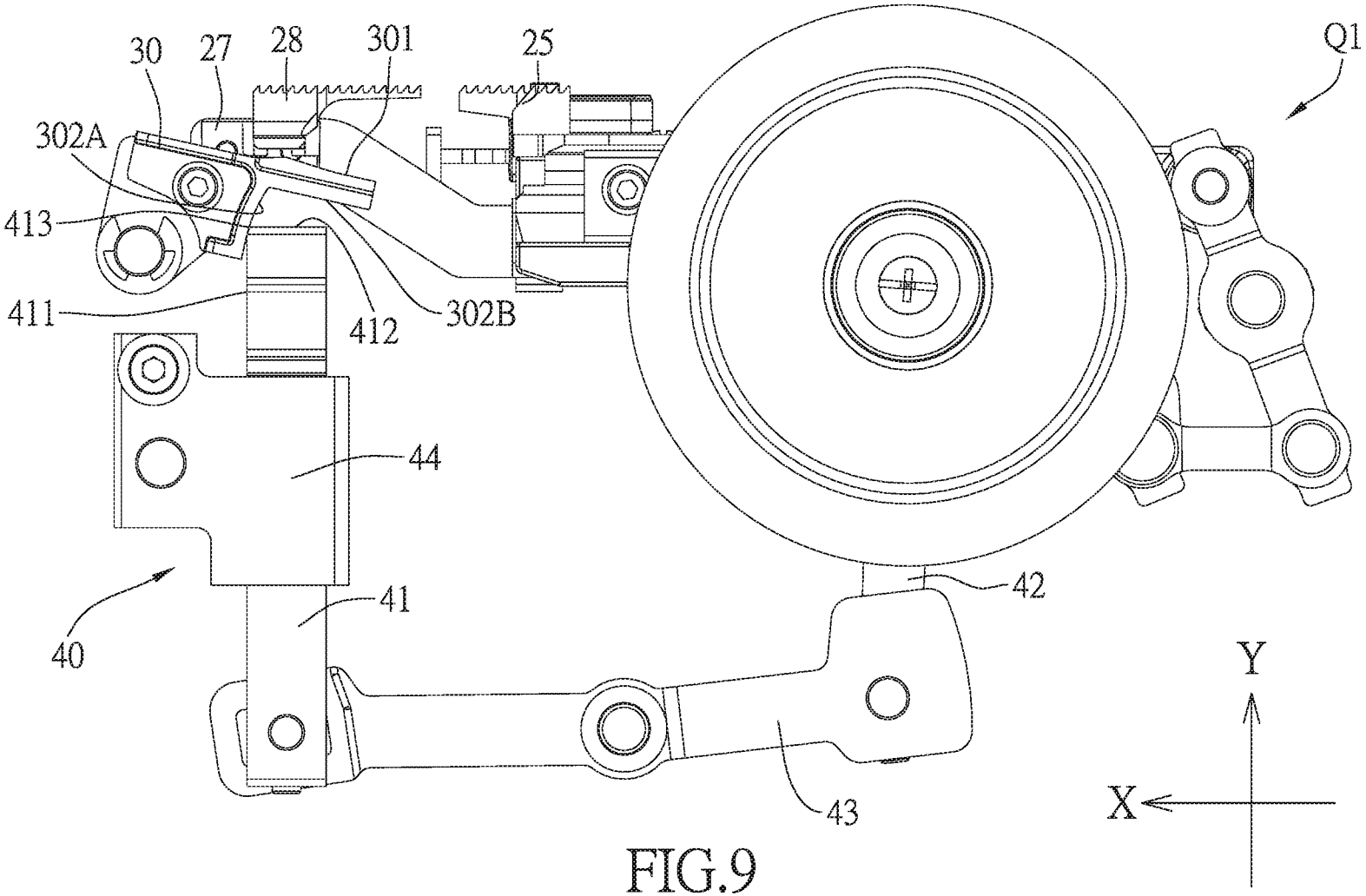
FIG. 9 is a side view of the feed-dog stabilizing mechanism for a sewing machine in accordance with another preferred embodiment of the present invention, showing that the driving arm is in a release position.
Figure 10:
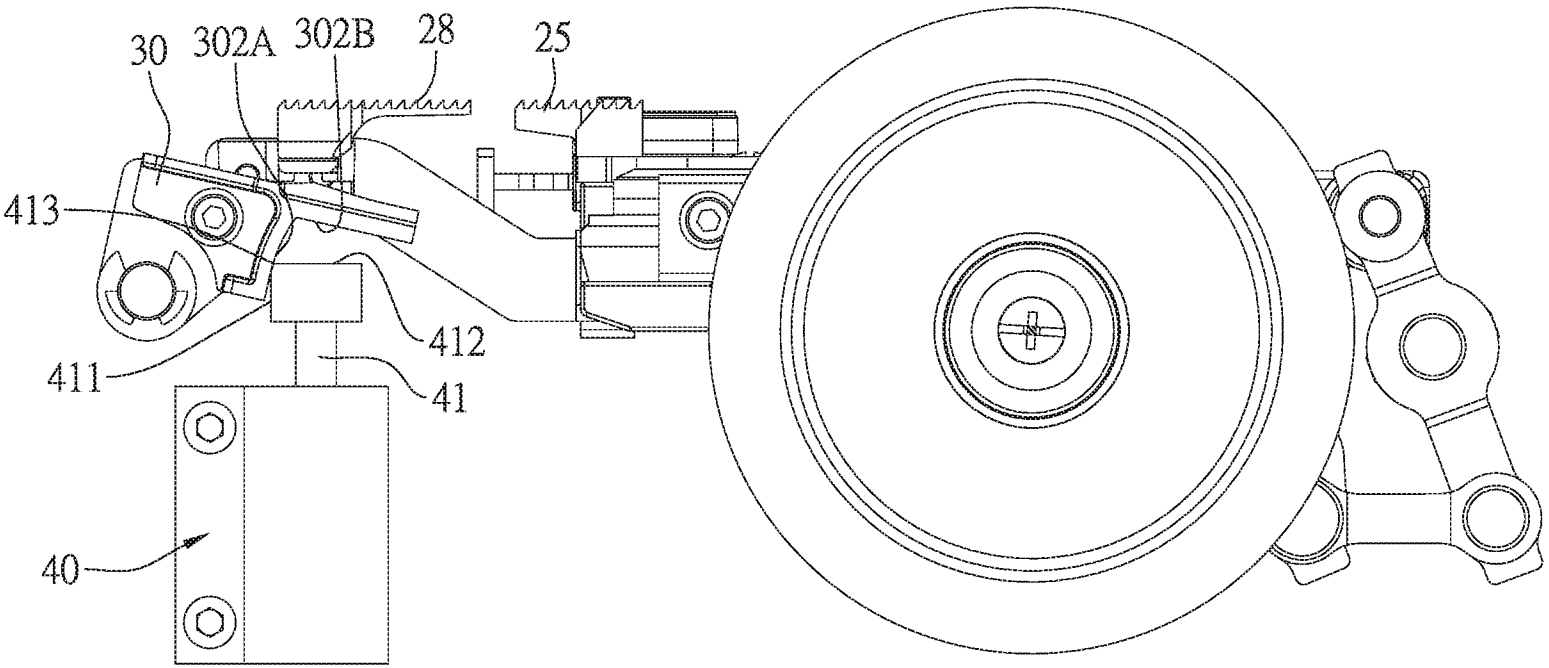
FIG. 10 is a side view of the drive source of the feed-dog stabilizing mechanism for a sewing machine in accordance with another preferred embodiment of the present invention.
Figure 11:
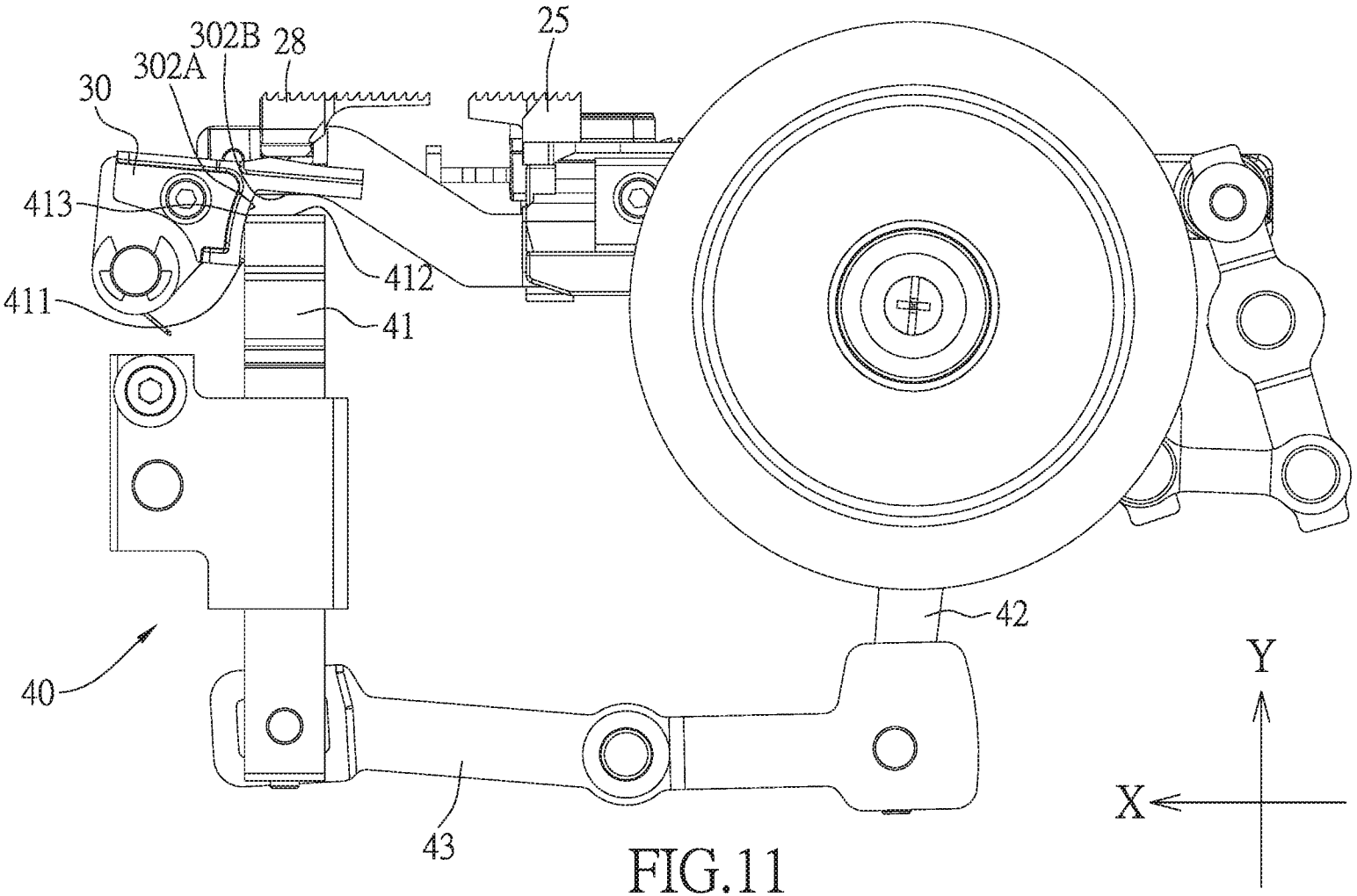
FIG. 11 is a side view of the feed-dog stabilizing mechanism for a sewing machine in accordance with another preferred embodiment of the present invention, showing that the driving arm moves toward the support member.
Figure 12:
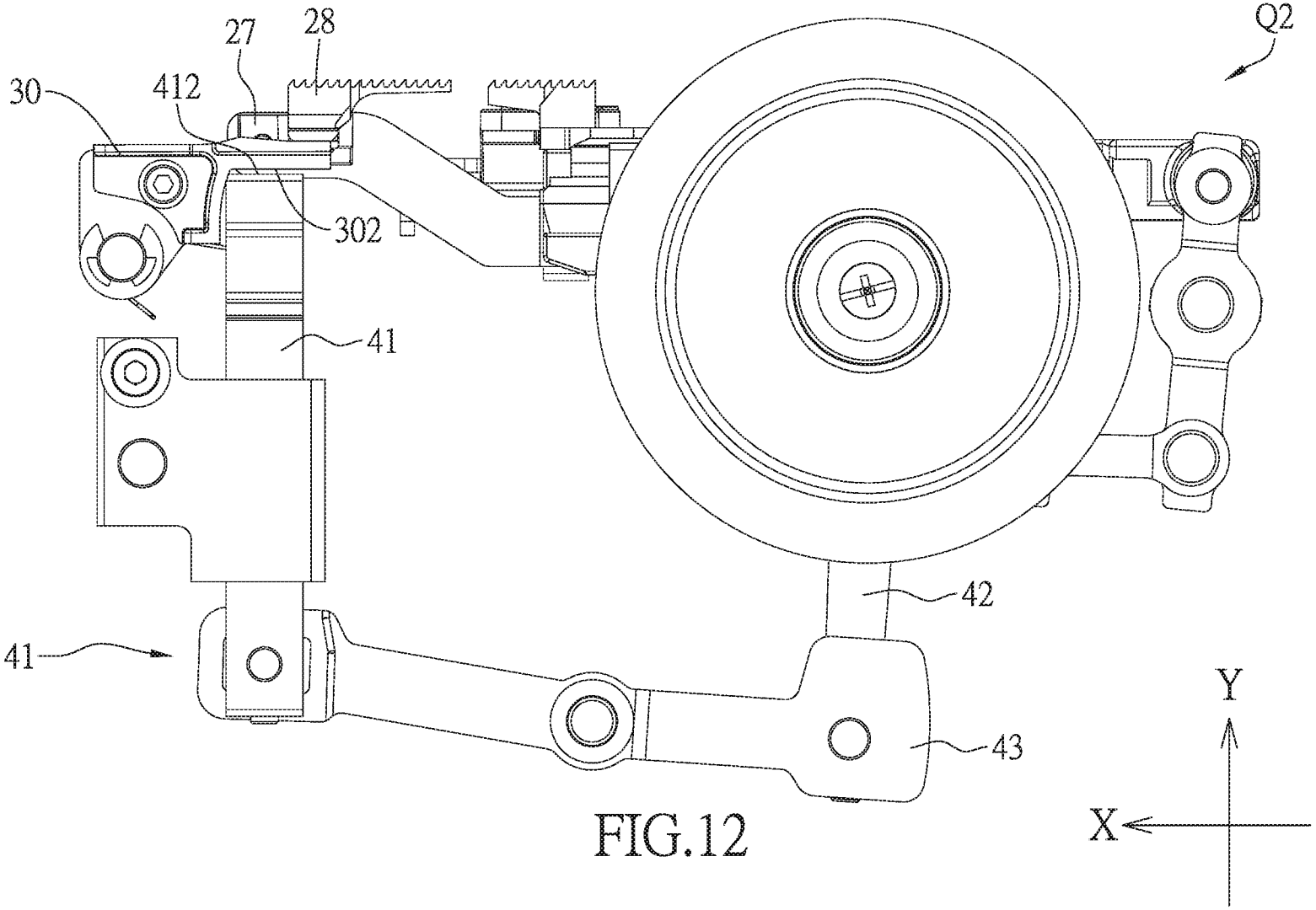
FIG. 12 is a side view of the feed-dog stabilizing mechanism for a sewing machine in accordance with another preferred embodiment of the present invention, showing that the driving arm is in a prop-up position.

The above is the structural configuration and connection relationship of the feed-dog stabilizing mechanism for a sewing machine of the present invention, and its operation is explained as follows:

When the driving arm 41 is in the release position Q1, as shown in FIG. 9, the abutting angle 413 abuts against the first abutting portion 302A, as shown in FIG. 8, by rotating the spindle 22, the eccentric linkage-rod hole 421 drives the first linkage rod 42 to pivot along the second direction X and the vertical direction Y, thereby driving the second linkage rod 43 to pivot about the second linkage-rod hole 432. The end of the second linkage rod 43 where the second pivot hole 431 is formed moves along the vertical direction Y toward the support member 30, so that the driving arm 41 is moved along the vertical direction Y toward the support member 30. The process of the displacement of the driving arm 41 is as shown in FIG. 8, wherein the abutting angle 413 abuts against the first abutting portion 302A to make the support member 30 move along the curvature of the first abutting portion 302A, thus causing pivoting motion of the support member 30, and finally causing the first abutting surface 301 of the support member to move toward the feed table 27.

When the driving arm 41 is in the prop-up position Q2, the second pushing surface 412 of the driving arm 41 abuts against the second abutting portion 302B, and the driving arm 41 continuously moves along the vertical direction Y toward the support member 30, so that the first abutting surface 301 of the support member 30 is abutted against the feed table 27, whereby the support member 30 pushes against the feed table 27.

Thereby, when the feed-dog stabilizing mechanism of the sewing machine of the present invention is in use, the feed table 27 is supported by the support member 30, thereby solving the disadvantage that the feed table 27 is easily deformed during use. In addition, the height at which the fabric is bitten by the feed dog can be maintained during the course of fabric feeding to maintain the optimum feeding efficiency.

While we have shown and described various embodiments in accordance with the present invention, it is clear to those skilled in the art that further embodiments may be made without departing from the scope of the present invention.

What is claimed is:

1. A feed-dog stabilizing mechanism for a sewing machine, comprising:

the sewing machine including a feed dog and a body;

a support member pivotally mounted on the body, and including: a first abutting surface facing the feed dog and a second abutting surface opposite to the first abutting surface, by pivoting the support member, the first abutting surface of the support member is able to abut against or move away from the feed dog; and a drive source having a driving arm, wherein the driving arm pushes the second abutting surface to move the support member;

wherein the drive source includes a first linkage rod, a second linkage rod and the driving arm, one end of the first linkage rod is pivotally connected to the second linkage rod, the second linkage rod has a middle section pivotally connected to the body of the sewing machine and has one end connected to the driving arm, so that, when the first linkage rod is driven by the sewing machine, the second linkage rod drives the driving arm to move.

2. The feed-dog stabilizing mechanism for the sewing machine as claimed in claim 1, wherein the drive source includes a motor which drives the driving arm to move.

3. The feed-dog stabilizing mechanism for the sewing machine as claimed in claim 1, wherein the drive source has a sleeve, the driving arm is disposed in the sleeve, and the sleeve is provided with a coil to drive the driving arm.

4. The feed-dog stabilizing mechanism for the sewing machine as claimed in claim 1, wherein the second abutting surface has an abutting portion to abut against the driving arm, through displacement of the driving arm, the first abutting surface supports the feed dog during displacement of the feed dog.

5. A feed-dog stabilizing mechanism for a sewing machine, comprising:

the sewing machine including a feed dog and a body;

a support member pivotally mounted on the body, and including: a first abutting surface facing the feed dog and a second abutting surface opposite to the first abutting surface, by pivoting the support member, the first abutting surface of the support member is able to abut against or move away from the feed dog; and a drive source having a driving arm, wherein the driving arm pushes the second abutting surface to move the support member;

wherein a spindle capable of transmitting power is disposed in the body, a bearing seat is mounted on the spindle, a sub-feed table is disposed in the body and rests against the bearing seat in a slidable manner, the sub-feed table is provided with a sub-feed dog, one end of the sub-feed table is provided with a clamping slot, an inserting rod is slidably inserted in the sub-feed table, a feed table is capable of sliding in the clamping slot, the feed table is fixed to the inserting rod, and the feed dog is provided on the feed table.

6. A feed-dog stabilizing mechanism for a sewing machine, comprising:

the sewing machine including a feed dog and a body;

a support member pivotally mounted on the body, and including: a first abutting surface facing the feed dog and a second abutting surface opposite to the first abutting surface, by pivoting the support member, the first abutting surface of the support member is able to abut against or move away from the feed dog; and a drive source having a driving arm, wherein the driving arm pushes the second abutting surface to move the support member;

wherein the drive source includes a first linkage rod, a second linkage rod and the driving arm, one end of the first linkage rod is pivotally connected to the second linkage rod, the second linkage rod has a middle section pivotally connected to the body of the sewing machine and has one end connected to the driving arm, so that, when the first linkage rod is driven by the sewing machine, the second linkage rod drives the driving arm to move;

the one end of the first linkage rod is provided with a first pivot hole, another end of the first linkage rod is provided with a linkage-rod hole, the second linkage rod has another end pivotally coupled to the first pivot hole by a first pivot rod, and has the one end provided with a second pivot hole, a second linkage-rod hole is formed between the two ends of the second linkage rod, the second linkage rod is pivotally coupled to the body by a pivot shaft inserted through the second linkage-rod hole, the driving arm has one end pivotally connected to the second pivot hole by a second pivot rod, a limiting member is fixed to the body and includes a limiting hole, and the driving arm is slidably disposed in the limiting hole.

7. The feed-dog stabilizing mechanism for the sewing machine as claimed in claim 6, wherein the drive source includes a motor which drives the driving arm to move.

8. The feed-dog stabilizing mechanism for the sewing machine as claimed in claim 6, wherein the drive source has a sleeve, the driving arm is disposed in the sleeve, and the sleeve is provided with a coil to drive the driving arm.

9. The feed-dog stabilizing mechanism for the sewing machine as claimed in claim 6, wherein the second abutting surface has an abutting portion to abut against the driving arm, through displacement of the driving arm, the first abutting surface supports the feed dog during displacement of the feed dog.

* * * * *